United States Patent [19]

van Laar et al.

[11] Patent Number: 4,879,014

[45] Date of Patent: Nov. 7, 1989

[54] REMOVAL OF ORGANIC ACIDS FROM FRESHLY PRODUCED BITUMEN

[75] Inventors: Hermanus G. van Laar; Richard H. Lea, both of Calgary; Beverley Payne, Corunna, all of Canada

[73] Assignee: Shell Oil Company, Houston, Tex.

[21] Appl. No.: 244,885

[22] Filed: Sep. 15, 1988

[30] Foreign Application Priority Data

Sep. 18, 1987 [CA] Canada ..... 547250

[51] Int. Cl.[4] ..... B03C 5/00

[52] U.S. Cl. ..... 204/190

[58] Field of Search ..... 204/190

[56] References Cited

U.S. PATENT DOCUMENTS 3,806,437 4/1974 Franse et al. ..... 204/190

*Primary Examiner*—T. M. Tufariello

[57] ABSTRACT

Process for removal of organic acids from bitumen comprising (a) Bitumen is diluted with low-density hydrocarbons.

(b) A dilute solution of caustic soda in water is intimately mixed with the diluted bitumen.

(c) A demulsifying chemical is added to weaken the interfacial layers between the bitumen phase and the aqueous phase.

(d) Coalescence between the droplets of the dispersed aqueous phase is achieved in an electrostatic dehydration vessel. Separation between the bitumen and aqueous phase is effected in the vessel.

(e) The acid-reduced bitumen is removed from the top of the coalescer and the aqueous organic salt solution from its bottom.

12 Claims, No Drawings

REMOVAL OF ORGANIC ACIDS FROM FRESHLY PRODUCED BITUMEN

FIELD OF THE INVENTION

The present invention relates to a method of removing acids from bitumen.

BACKGROUND OF THE INVENTION

Some natural bitumens and heavy crude oils, including those occurring in North West Canada, contain organic acids. For instance, Peace River bitumen contains naphthenic, sulphonic and other organic acids in such quantities that between 3 and 5 mg of potassium hydroxide are required to neutralize one g of bitumen (Total Acid Number, TAN).

Under normal operating conditions such bitumen causes no corrosion of any consequence in producing wells, production facilities and pipelines. However, in the refinery, at high process temperatures, very severe corrosion of carbon steel process equipment will occur.

One approach of preventing such corrosion is protecting all refinery process facilities exposed to acidic crude oil by the use of stainless steel. Another approach is to eliminate the acids up-stream, in the field production facilities. The latter approach is the subject of this invention.

SUMMARY OF THE INVENTION

The invention therefore relates to a process for the removal of organic acids from freshly produced bitumen comprising the following steps:

(a) Freshly produced, acidic bitumen is diluted with a low density hydrocarbon blend to create a favorable density difference with an aqueous phase.

(b) A dilute solution of caustic soda in water is intimately mixed with the diluted bitumen, allowing caustic soda to react with the acids in the bitumen.

(c) At least one demulsifying chemical is added to weaken the interfacial layers between the de-acidized bitumen phase and the organic salt containing aqueous phase.

(d) Coalescence between the weakened droplets of the dispersed aqueous phase is achieved in an electrostatic dehydration vessel. Separation between the bitumen and aqueous phase is effected in the vessel.

(e) The acid-reduced bitumen is removed from the top of the electrostatic coalescer vessel and the aqueous organic salt solution from its bottom.

The low density hydrocarbon blend used for the dilution of the freshly produced acidic bitumen, preferably boils in the range of from −10° to 350° C. (composition: $C_4$-$C_8$ hydrocarbons). Advantageously they consist of a low boiling petroleum distillate fraction. Very suitable for the dilution of the said bitumen are natural gas condensates.

In order to create a favorable density difference with the aqueous phase the bitumen is preferably diluted with 15 to 20% by volume of low density hydrocarbon blend.

Upon dilution with low density hydrocarbon blend the diluted bitumen is intimately mixed with a dilute solution of caustic soda in water. The caustic soda neutralizes the acids present in the bitumen and the neutralized acids are taken up in the aqueous phase. In order to obtain optimum results in the neutralization step the dilute solution of caustic soda in water preferably contains from 1 to 3% by weight caustic soda, the diluted bitumen is preferably mixed with 7 to 23% by volume of the dilute solution of caustic soda in water and the mixing of the diluted bitumen and the dilute solution of caustic soda is preferably carried out at a temperature in the range of from 130° to 150° C. As a result of the mixing of the diluted bitumen with the dilute solution of caustic soda an emulsion is formed. Eventually, the diluted bitumen is separated from the dilute solution of caustic soda containing the neutralized acids. The emulsion is destabilized for this purpose. For example, the emulsion is destabilizied by adding a demulsifying chemical to the mixture of diluted bitumen and dilute caustic soda. The demulsifying chemical can be added together with the dilute solution of caustic soda. Any suitable demulsifying chemical can be used which will demulsify the mixture, but preferably the demulsifying chemical comprises an oxalkylated phenol-formaldehyde resin.

The amount of demulsifying chemical to be added to the mixture of diluted bitumen and dilute solution of caustic soda is dependent upon the amount of demulsifier and the mixture, and is preferably in the range of from 50 to 150 mg/l. The destabilized emulsion is passed to an electrostatic dehydration vessel in order to separate the aqueous phase from the diluted bitumen. Any suitable electric treater can be used for this purpose. A very suitable electric treater is described in U.S. patent specification No. 3,343,720. In the electrostatic dehydration vessel the weakened droplets of the dispersed aqueous phase coalesce so that separation between the diluted bitumen and the aqueous phase takes place. In the electrostatic dehydration vessel a suitable voltage gradient should be maintained in order to achieve this goal. Advantageously a voltage gradient in the range from 6 to 30 KV/inch is applied.

The dry, neutralized diluted bitumen phase is withdrawn from the top of the electrostatic dehydration vessel and the spent dilute caustic soda solution is removed from the bottom of the said vessel.

EXAMPLES

The invention will now be further illustrated by means of the following Example to which the present patent application is by no means restricted.

EXAMPLE

Peace River bitumen (Tan~4 mg/g) is being produced at a rate of 400 $m^3$/d. After blending in the field with diluent, gas condensate, (20% by volume on dry bitumen), the associated produced water is separated in a free water knock-out vessel. The comparatively dry diluted bitumen stream (480 $m^3$/d, water cut<1.0%), which now has reached a temperature of 140 ° C., is treated with 1000 kg/day of caustic soda. This amount is sufficient to remove the TAN to a level of 0.5 mg/g. Caustic soda (NaOH) is added as a 2% wt aqueous solution; 50 $m^3$/d of this solution is injected into the diluted bitumen, upstream of the electrical coalescer. A static mixer is placed in the line between the caustic soda injection point and the coalescer in order to provide intensive mixing of the oil and water phases, enhancing conditions of intimate contact between the organic acids and the caustic soda and thus promoting the chemical neutralization reactions.

A demulsifying chemical (oxalkylated phenol-formaldehyde resin at 50 to 150 mg/l) is injected together with the caustic soda in order to destabilize the waterin-oil emulsions formed during the process of mixing and chemical reacting. As a result, 530 $m^3/d$ of a comparatively destabilized emulsion, containing 9.4% of aqueous phase, reaches the electrical coalescer. Electrostatic coalescence of the destabilized water droplets and subsequent gravity separation into a dry, neutralized diluted bitumen phase (500 $m^3/d$, watercut<0.5%, TAN 0.5) and an aqueous spent caustic soda phase (50 $m^3/d$, organic salt solution, pH 12) takes place.

The neutralized diluted bitumen is pumped down the pipeline to the markets, while the spent caustic soda is further treated to recover valuable organic acids.

What is claimed is:

1. A process for removal of organic acids from freshly produced bitumen comprising the following steps:

(a) freshly produced, acidic bitumen is diluted with a low-density hydrocarbon blend to create a favorable density difference with an aqueous phase, (b) a dilute solution of caustic soda in water is intimately mixed with the diluted bitumen, allowing caustic soda to react with the acids in the bitumen, (c) at least one demulsifying chemical is added to weaken the interfacial layers between the de-acidized bitumen phase and the organic salt containing aqueous phase, (d) coalescence between the weakened droplets of the dispersed aqueous phase is achieved in an electrostatic dehydration vessel whereby separation between the bitumen and aqueous phase is effected in the vessel, and (e) the acid-reduced bitumen is removed from the top of the electrostatic coalescer vessel and the aqueous organic salt solution from its bottom.

2. A process according to claim 1 in which the low-density hydrocarbon blend boils in the range of from −10° to 350° C.

3. A process according to claim 1 in which the low density hydrocarbon blend consist of a natural gas condensate.

4. A process according to claim 1 in which the bitumen is diluted with 15 to 20% by volume of low-density hydrocarbon blend.

5. A process according to claim 1 in which the dilute solution of caustic soda in water contains from 1 to 3% by weight caustic soda.

6. A process according to claim 1 in which the diluted bitumen is mixed with 7 to 23% by volume of the dilute solution of caustic soda in water.

7. A process according to claim 1 in which the mixing of the diluted bitumen and the diluted solution of caustic soda is carried out at a temperature in the range of from 130° to 150° C.

8. A process according to claim 1 in which the demulsifying chemical comprises oxyalkylated phenol-formaldehyde resin.

9. A process according to claim 1 in which the amount of demulsifying chemical added to the mixture of diluted bitumen and dilute solution of caustic soda is in the range of from 50 to 150 mg/l.

10. A process according to claim 1 in which coalescence between the weakened droplets of the dispersed aqueous phase is achieved in the electrostatic dehydration vessel at a voltage gradient in the range of from 6 to 30 KV/inch.

11. A process according to claim 1 in which the low density hydrocarbon blend boils in the range of from −10° to 350° C. and the dilute soda solution contains from 1 to 3% by weight caustic soda.

12. A process according to claim 11 wherein the demulsifying chemical comprises oxyalkylated phenol-formaldehyde resin.

* * * * *